United States Patent [19]

Corrigan

[11] Patent Number: 4,882,024

[45] Date of Patent: Nov. 21, 1989

[54] HYDROGEN GENERATOR HAVING A LOW OXYGEN OVERPOTENTIAL ELECTRODE

[75] Inventor: Dennis A. Corrigan, Troy, Mich.

[73] Assignee: General Motors Corporation, Detroit, Mich.

[21] Appl. No.: 157,516

[22] Filed: Feb. 17, 1988

Related U.S. Application Data

[63] Continuation-in-part of Ser. No. 36,193, Apr. 8, 1987, abandoned, which is a continuation of Ser. No. 834,281, Feb. 25, 1986, abandoned.

[51] Int. Cl.[4] ..... C25C 7/02; C25B 11/06

[52] U.S. Cl. ..... 204/242; 204/290 R

[58] Field of Search ..... 204/242, 293, 291, 292, 204/37.1, 101, 257, 258, 290 R, 265, 266, 129, 275, 277, 278, 252

[56] References Cited

U.S. PATENT DOCUMENTS

| | | | |
|---|---|---|---|
| 3,282,808 | 11/1966 | Kandler | 204/37.1 |
| 4,384,928 | 5/1983 | Hall | 204/293 |
| 4,537,674 | 8/1985 | Ovshinsky | 502/101 |

OTHER PUBLICATIONS

Corodoba, Carbonia, Teijelo and Macagno, Oxygen Evolution Reaction on Chemically Co-Precipitated Nickel Hydroxide-Iron Hydroxide Mixture Electrode, extended abstract of paper presented at 36th Internation Society of Electrochemistry meeting held in Salamanca, Spain on Sep. 23-28, 1985.

J. M. Gras et M. Pernot, Oxygen Overvoltages on 50-50 Ni-Fe in KOH 40 w/o, Proceedings of the Symposium on Electrode Materials and Processes for Energy Conversion and Storage, 1977.

G. Mlynarek, M. Paszkiewicz, and A. Radniecka, The Effect of Ferric Ions on the Behaviour of a Nickelous Hydroxide Electrode, Journal of Applied Electrochemistry, 14, 145-149 (1984).

Dyer, Improved Nickel Anodes for Industrial Water Electrolyzers, Journal of the Electrochemical Society, vol. 132, No. 1, pp. 64-67, Jan. 1985.

Hall, $Ni(OH)_2$—Impregnated Anodes for Alkaline Water Electrolysis, Journal of the Electrochemical Society, vol. 130, No. 2, pp. 317-321, Feb. 1983.

Corrigan and Maheswari, The Catalysis of the Oxygen Evolution Reaction by Trace Iron Impurities in Thin Film Nickel Oxide Electrodes, Journal of the Electrochemical Society Reviews and News, Abstract No. 664, Mar. 1985.

Corrigan and Maheswari, The Catalysis of the Oxygen Evolution Reaction by Trace Iron Impurities in Thin Film Nickel Oxide Electrodes, Extended Abstract No. 664 of a paper presented at the Spring Meeting of the Electrochemical Society, Toronto, Ontario, Canada (May 12-17, 1985), vol. 85-1.

Corrigan, The Catalysis of the Oxygen Evolution Reaction by Trace Iron Impurities in Thin Film Oxide Electrodes, slides of extemporaneous presentation given at May 1985 meeting of Electrochemical Society in Toronto, Canada.

Hall, Porous Nickel-Coated Steel Anodes for Alkaline Water Electrolysis: Corrosion Resistance, Journal of the Electrochemical Society, Electrochemical Science and Technology, vol. 129, No. 2, pp. 310-315, Feb. 1982.

D. E. Hall, Electrodes for Alkaline Water Electrolysis, Journal of the Electrochemical Society: Electrochemical Science and Technology, vol. 128, No. 4, pp. 740-746, (Apr. 1981).

(List continued on next page.)

*Primary Examiner*—John F. Niebling
*Assistant Examiner*—Ben C. Hsing
*Attorney, Agent, or Firm*—Lawrence B. Plant

[57] ABSTRACT

An alkaline electrolytic hydrogen generator having an anode including a low oxygen overpotential catalyst comprising a composite hydrous oxide of nickel and iron in which the nickel content varies from about 0.6 to about 19 parts nickel per part iron. The catalyst will preferably comprise an electrochemically coprecipitated coating on a conductive substrate.

3 Claims, 2 Drawing Sheets

OTHER PUBLICATIONS

S. I. Cordoba et al., "The Electrochemical Response of Binary Mixtures of Hydrous Transition Metal Hydroxides Coprecipitated on Conducting Substrates with Reference to the Oxygen Evolution Reaction", Electrochimica Acta, 31, 10, 1321-1332, (1986).

S. I. Cordoba et al., "The Effect of Iron Hydroxide on Nickelous Hydroxide Electrodes with Emphasis on the Oxygen Evolution Reaction", Electrochemica Acta, 32, 5, 749-755 (1987).

D. A. Corrigan, "The Catalysis of the Oxygen Evolution Reaction by Iron Impurities in Thin Film Nickel Oxide Electrodes", J. Electrochem. Soc., 134, No. 2, Feb. 1987.

D. A. Corrigan et al., "In Situ Mossbauer Study of Redox Processes in a Composite Hydroxide of Iron and Nickel", J. Phys. Chem., 91, 5009-5011 (1987).

D. P. Gregory, "Modern Aspects of Electrochemistry", vol. 10, J. O'M Bockris and B. E. Conway, Editors, Plenum Press, New York (1975).

B. Danzfuss and U. Stimming, J. Electroanal. Chem., 164, 89 (1984).

F. Gutmann and O. J. Murphy, "Modern Aspects of Electrochemistry", vol. 15, R. E. White, J. O'M Bockris and B. E. Conway, Edition, Plenum Press, New York (1983).

J. Orehotsky et al., "Oxygen Evolution on $Ni_xFe_{3-x}O_4$ Electrodes", J. Electroanal. Chem., 95 (1979) 233-235.

S. Jasem and A. C. C. Tseung, "Electrode Materials and Processes for Energy Conversion and Storage", J. D. E. McIntyre, S. Srinivasan, and F. G. Will, Editors, p. 414, The Electrochemical Society Softbound Proceedings Series, Princeton, N.J. (1977).

J. O'M Bockris et al., "The Electrocatalysis of Oxygen Evolution on Perovskites", J. Electrochem. Soc., Feb. 1984, 131, 2, pp. 290-302.

P. Rasiyah et al., "A Mechanistic Study of Oxygen Evolution on $NiCo_2O_4$", J. Electrochem. Soc., 130, 12, 2384-2386 (Dec. 1983).

S. U. Falk and A. J. Salkind, "Alkaline Storage Batteries", John Wiley & Sons, Inc., New York (1969).

M. Z. A. Munshi, A. C. C. Tseung, and J. Parker, J. Appl. Electrochem., 15, 711 (1985).

A. Hickling and S. Hill, Discuss. Faraday Soc., 1, 236 (1947).

M. L. Moss and M. G. Mellon, Ind. Eng. Chem., 14, 862 (1942).

D. J. G. Ives and G. J. Janz, "Reference Electrodes Theory and Practice", Academic Press, Inc., New York (1961).

B. E. Conway and P. L. Bourgault, Trans. Faraday Soc., 58, 593 (1962).

G. W. D. Briggs, "Electrochemistry: Specialist Periodical Reports", vol. 4, p. 33, The Chemical Society, London (1947).

P. Oliva, J. Leonardi, J. F. Laurent, C. Delmas, J. J. Braconnier, M. Figlarz, F. Fievet, and A. deGuibert, J. Power Sources, 8, 119 (1982).

D. M. MacArthur, This Journal, 117, 422 (1970).

G. Bronoel and J. Reby, Electrochim. Acta, 25, 973 (1980).

H. Gomez Meier, J. R. Vilche, and A. J. Arvia, J. Appl. Electrochem., 10, 611 (1980).

L. D. Burke and T. A. M. Twomey, "Nickel Electrode", R. G. Gunther and S. Gross, Editors, p. 75, The Electrochemical Society Softbound Proceedings Series, Pennington, N.J. (1982).

J. F. Wolfe, L—S. R. Yeh, and A. Damjanovic, Electrochim. Acta. 26, 409 (1981).

S. H. Glarum and J. H. Marshall, This Journal, 129, 535 (1982).

M. J. Madou and M. C. H. McKubre, ibid., 130, 1056 (1983).

W. Visscher and E. Barendrecht, J. Electroanal. Chem., 154, 69 (1983).

J. O'M Bockris, J. Chem. Phys., 24, 817 (1956).

A. C. Riddiford, Electrochim. Acta, 4, 170 (1961).

P. W. T. Lu and S. Srinivasan, This Journal, 125, 1416 (1978).

R. E. Meyer, ibid., 107, 847 (1960).

R. L. Tichener, Ind. Eng. Chem., 44, 973 (1952).

D. E. Hall, This Journal, 130, 317, (1983).

Y. D. Chen and R. N. Noufi, ibid., 131, 731 (1984).

M. D. Thompson and A. L. Kaye, Trans. Electrochem. Soc., 60, 229 (1931).

G. Grube and W. Gaupp, Z. Elektrochem., 45, 290 (1939).

HYDROGEN GENERATOR HAVING A LOW OXYGEN OVERPOTENTIAL ELECTRODE

This is a continuation-in-part of U.S. patent application Ser. No. 036,193, filed Apr. 8, 1987, as a continuation of U.S. Ser. No. 834,281, filed Feb. 25, 1986 both now abandoned.

This invention relates to a low oxygen overpotential catalyst particularly useful for the oxygen-evolving anodes of alkaline electrolysis cells for generating hydrogen.

BACKGROUND OF THE INVENTION

There is an existing and potential market for hydrogen as a fuel and for use in the fertilizer, chemical, and metallurgical industries. Electrolysis is an attractive process for the production of hydrogen when cheap electrical power is available. Alkaline electrolysis cells for the generation of hydrogen are well known in the art and are described in such publications as B. V. Tilak et al, *Comprehensive Treatise of Electrochemistry,* Volume 2, Pages 1–31, Plenum Press, New York and London, 1981. Such cells typically comprise an hydrogen-evolving cathode, an oxygen-evolving anode, an alkaline electrolyte (i.e., typically 25–35% KOH) therebetween and may have either a monopolar or bipolar construction. A major source of energy inefficiency in such cells is the high oxygen overpotential at the anode. Accordingly, considerable effort has been focused on reducing this overpotential to improve energy efficiency.

It is well known that the composition of the anode significantly affects its oxygen overpotential. Nickel and its alloys (i.e., nickel-iron) have been used as anodes in alkaline electrolytic hydrogen generators owing to their high corrosion resistance at anodic potentials. However, the oxygen overpotential on nickel is undesirably high. Dyer (C. K. Dyer, *Improved Nickel Anodes for Industrial Water Electrolyzers,* Journal of the Electrochemical Society, Vol. 132, No. 1, Pages 64–67, January 1985) has reported that a thin coating of hydrous nickel oxide catalyst precipitated onto a porous nickel anode lowers its oxygen overpotential by about 40–60 millivolts at 200 milliamperes per centimeter squared ($mA/cm^2$). See also D. E. Hall, $Ni(OH)_2$—*Impregnated Anodes for Alkaline Water Electrolysis,* Journal of the Electrochemical Society, Vol. 130, No. 2, Pages 317–321 (Feb. 1983). Anodes so catalyzed, however, still have: an unnecessarily high initial oxygen overpotential; Tafel slopes of over 70 mV/decade; and tend to deactivate with time thereby causing their initial oxygen overpotential to steadily increase to even higher levels over the life of the anode.

Others have reported that nickel ferrite spinels made by freeze drying catalyze the oxygen evolution reaction (see J. Orehotsky et al *Oxygen Evolution on* $Ni_xFe_{3-x}O_4$ *Electrodes,* J. Electroanal. Chem. Vol. 95 (1979) 233–235). These spinels are anhydrous and are Teflon-bonded to a wire screen to form the electrodes. Similarly prepared electrodes employing $NiCo_2O_4$ spinels have been reported by Rasiyah et al, *A Mechanistic Study of Oxygen Evolution on* $NiCo_2O_4$, J. Electrochem. Soc. Vol. 130 (Dec. 1983) 2384–2386. The lowest Tafel slope reported for such spinel catalyzed electrodes is 37 mV/decade and electrodes so made have not achieved commercial acceptance in hydrogen generators. Finally, the affects of nickel or iron containing perovskites on the oxygen evolution reaction have been studied (see J. Bockris, *The Electrocatalysis of Oxygen Evolution on Perovskites,* J. Electrochemical Soc., Vol. 131, pp. 290–302, Feb. 1984. Such perovskites, however, have demonstrated Tafel slopes no better than 43 mV/decade and not received commercial acceptance.

Accordingly it is an object of the present invention to provide an electrolytic hydrogen generator with an anode having a unique, highly stable catalyst which significantly reduces the anode's oxygen overpotential. It is a further object of the present invention to provide a species of such catalyst which not only provides such reduced overpotential but which also has a surprisingly low rate of deactivation. These and other objects and advantages of the present invention will become more readily apparent from the detailed description thereof which follows.

BRIEF DESCRIPTION OF THE INVENTION

The present invention comprehends an alkaline, electrolytic hydrogen generator (hereafter electrolytic hydrogen generator) comprising an anode, a cathode and an alkali metal hydroxide electrolyte therebetween wherein the anode includes an oxygen evolution catalyst comprising a composite hydrous oxide of nickel and iron (hereafter composite oxide) having a brucite-type, hexagonal layered structure wherein the nickel content thereof broadly varies from about 0.6 parts to about 19 parts of nickel per part of iron therein, and preferably varies from about 1 part to about 9 parts nickel per part of iron in order to obtain minimum overpotentials over a wide range of high current densities (i.e., low Tafel slopes). Uniform coatings of such catalysts prepared by electrochemical coprecipitation will produce electrodes having long term durability and accordingly are the preferred electrodes for hydrogen generators. Surprisingly, such preferred anodes have demonstrated (i.e., at 8 $mA/cm^2$ polarization): oxygen overpotentials which were over 200 millivolts lower than nickel oxide/hydroxide electrodes; Tafel slopes (i.e., overvoltage vs. log current density) of about 25 mV/decade, which is significantly lower than either hydrous nickel oxide (i.e., over 70 mV/decade) or hydrous iron oxide (i.e., about 60 mV/decade) alone; and significantly more stability against deactivation than nickel oxide electrodes similarly formed. More specifically, the preferred anode will comprise a conductive substrate (e.g., nickel, nickel coated steel, etc.) having the composite oxide electrochemically coprecipitated adherently and uniformly onto its surface as, for example, by the process described by U.S. Pat. No. 3,282,808, to Kandler wherein the substrate is immersed in a aqueous solution of nickel and iron salts, which salts are thereafter electrochemically reduced and deposited as very fine oxides/hydroxides throughout the substrate. The substrate will most preferably be thin and have a high surface area (e.g., sintered nickel particles) which is coated with the composite oxide catalyst. In this regard, impregnation of a porous substrate with the catalyst will be relatively light (e.g., as compared to Kandler's battery plate loadings) and such as not to substantially plug the pores and thereby inhibit electrolyte penetration thereof. Electrolytically coprecipitated composite oxide is uniformly distributed across, and appears to adhere better to the substrate than similar composite oxides deposited by other methods thereby contributing to the durability of the electrodes in service. As initially formed, the nickel content of the composite oxide will be present as divalent nickel while the iron will be present as trivalent iron. Once in service, however, the nickel is oxidized to a higher level (i.e., trivalent and/or quadrivalent nickel).

EXAMPLES

The following describes certain tests and the results thereof conducted relative to the present invention, which results are reflected in the several drawings wherein.

Figure 1:
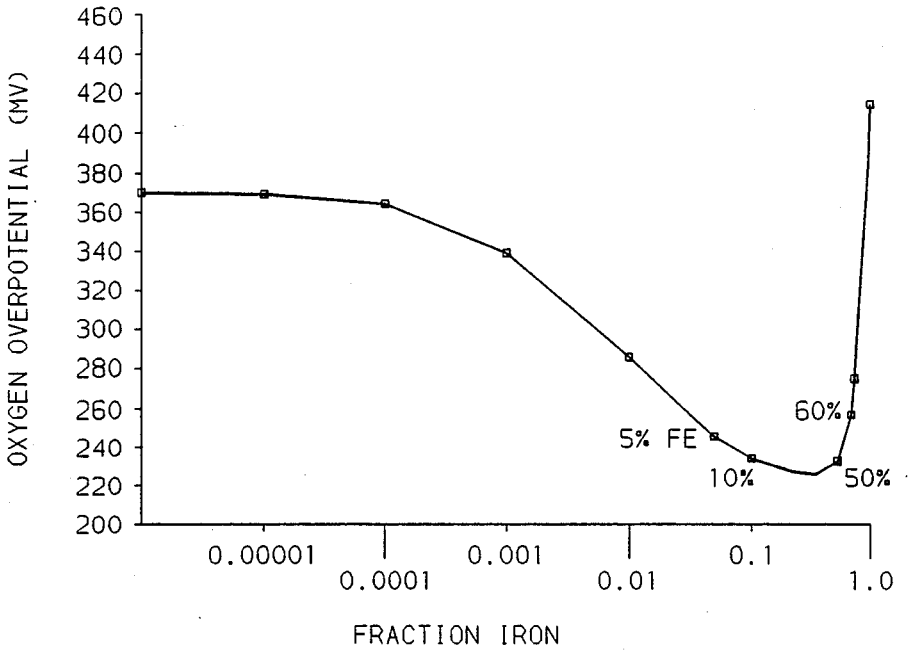
FIG. 1 is a graph showing oxygen overpotentials (i.e., at 8 mA/cm$^2$ polarization) at various levels of iron in the composite catalyst of the present invention.

The tests reported hereafter were conducted at room temperature in a 25% aqueous solution reagent grade KOH further Purified by preelectrolysis. The substrates for the hydrous nickel oxide and composite oxide comprised 0.1 mm thick nickel foil (99.8% Ni) cut into 2.5×7.6 cm strips. The strips were cleaned chemically and electrochemically before depositing the catalyst thereon. The strips were immersed 2.5 cm into a solution of 0.1 M nickel nitrate and the hydrous nickel oxide cathodically deposited thereon at 100 mA (i.e., 8 mA/cm$^2$) for 100 seconds which yielded a loading thereof of about 0.5 mg/cm$^2$. When hydrous iron oxide was to be electrolytically coprecipitated with the hydrous nickel oxide, ferric nitrate was added to the nickel nitrate solution (adjusted to pH-2 with nitric acid) prior to cathodization of the foil. Anodes comprising hydrous iron oxide on an iron foil were also prepared and tested (see curve B of FIG. 2) for comparison to iron-free hydrous nickel oxide and the composite oxide of the present invention.

The test cell was designed to provide uniform current density to both sides of a 2.5 cm wide test electrode immersed to a depth of 2.5 cm in the electrolyte so as to provide an electrode area of 12.5 cm$^2$. Nickel foil counter electrodes (2.5 cm×2.5 cm) were placed at both ends of the cell on opposite sides of, and spaced 2.5 cm from the test electrode. The reference electrode was an external Hg/HgO reference electrode in 25 w/o KOH. It made contact to the electrolyte in the test cell via a polypropylene tube inserted into a hole in the side of the cell in communication with the electrolyte via a 0.5 mm diameter opening in the cell wall about 2.5 mm from the test electrode.

FIG. 1 shows a plot of the oxygen overpotentials (i.e., measured at 8 mA/cm$^2$) of anodes catalyzed with composite oxide having various levels of iron content. The elbow-shaped curve shows that substantially reduced oxygen overpotentials are obtained when the iron content of the composite oxide is between about 5% and 60% of the total nickel and iron content (i.e., between about 19 and 0.6 parts nickel per 1 part iron respectively). The curve also shows that optimum results are achieved in the range of about 10% to about 50% iron (i.e., between about 9 and 1 part nickel per 1 part iron). Higher polarization current densities (e.g., >100 mA/cm$^2$), such as are used in commercial electrolyzers, would cause the elbow of the curve to drop even lower on the oxygen overpotential scale.

Figure 2:
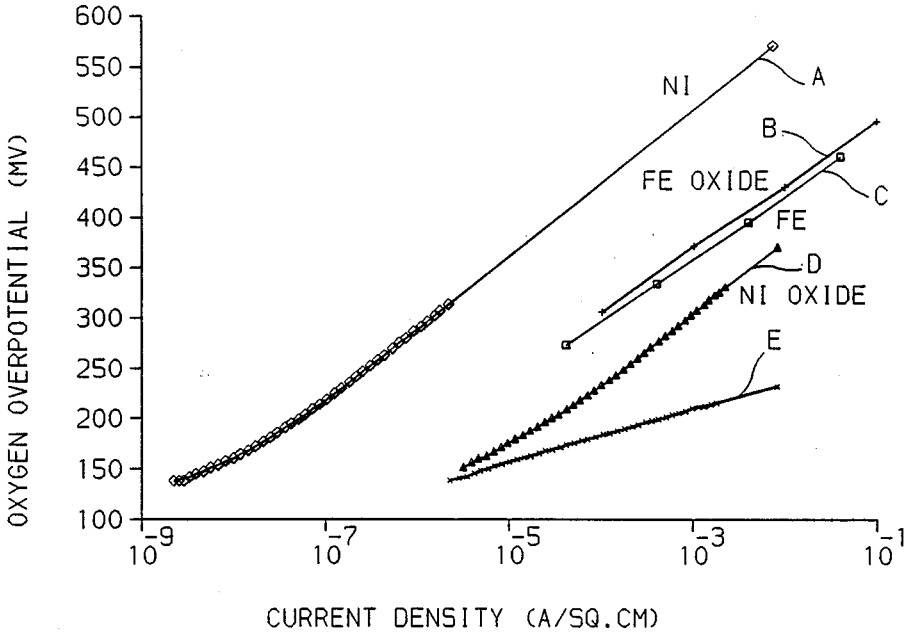
FIG. 2 are polarization curves for several different electrodes.
Figure 3:
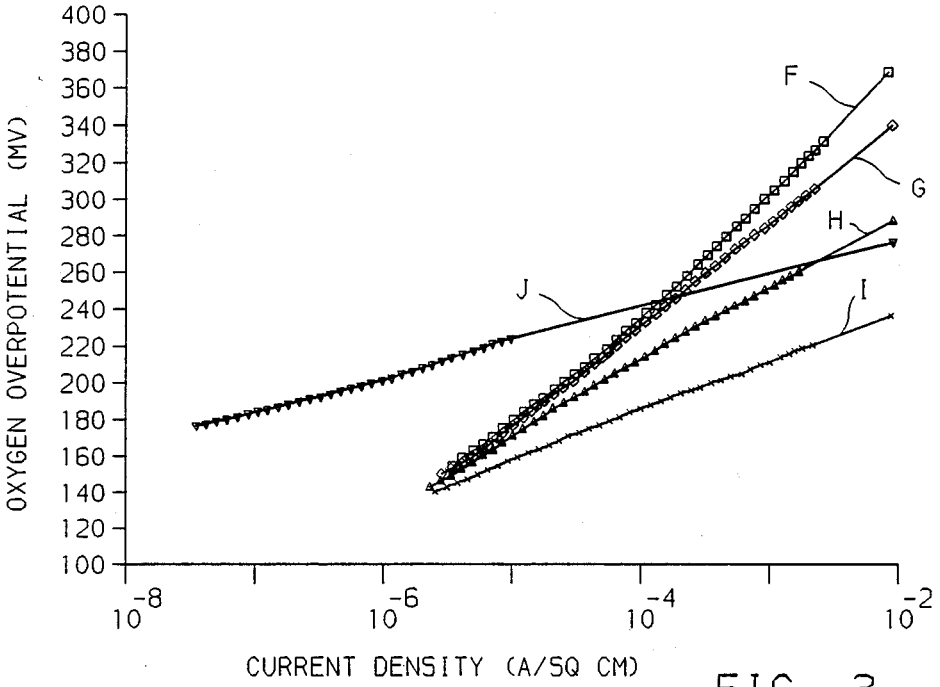
FIG. 3 are polarization curves for several electrodes having composite oxides thereon but with various levels of iron content.
Figure 4:
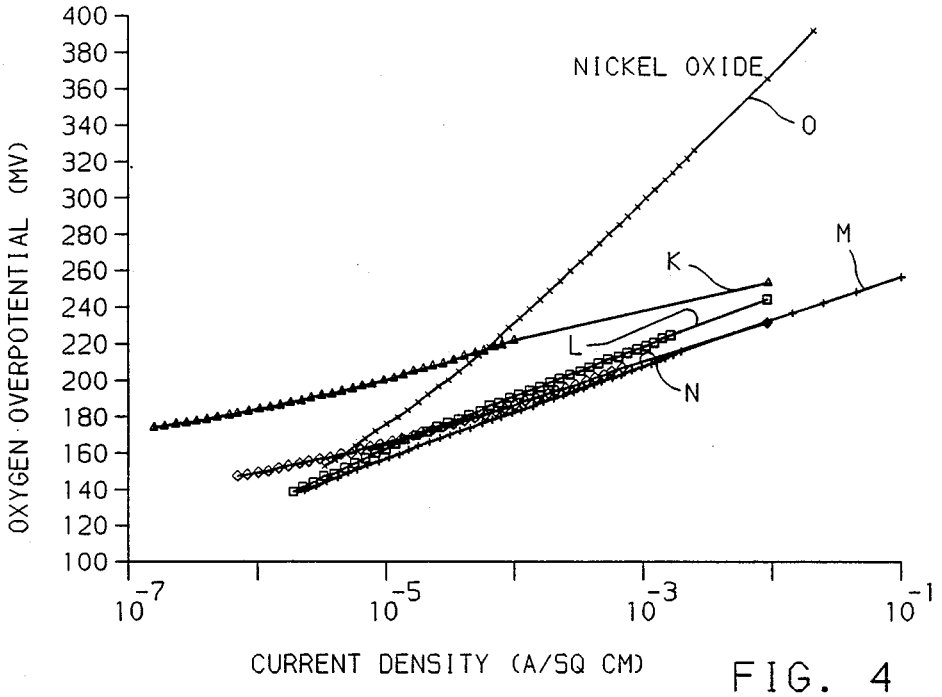
FIG. 4 are polarization curves for several anodes catalyzed in accordance with the present invention and compared to a hydrous nickel oxide catalyzed anode.

FIGS. 2–4 show the Tafel slopes of the test electrodes determined by both the "open circuit potential decay" (i.e., B. E. Conway and P. L. Bourgault at Can. J. Chem., 37, 292 (1959) and Trans. Faraday Soc., 58, 593 (1962)) and better known "steady state polarization" methods.

FIG. 2 shows the polarization curves of several different anodes. More specifically at 8 mA/cm$^2$, the curves show the following Tafel slopes:

Curve A—about 80 mV/decade (pure nickel);
Curve B—about 64 mV/decade (hydrous iron oxide);
Curve C—about 64 mV/decade (pure iron);
Curve D—about 72 mV/decade (hydrous nickel oxide); and
Curve E—about 25 mV/decade (composite oxide—Ni:Fe::9:1).

The FIG. 2 then shows the significantly lower Tafel slope of the composite oxide of the present invention over hydrous nickel oxide and hydrous iron oxide alone and hence the significantly reduced oxygen overpotential to be expected under electrolysis conditions.

FIG. 3 shows the polarization curves for several composite oxides at various levels of iron content. More specifically at 8 mA/cm$^2$, the curves show the following Tafel slopes:

Curve F—about 72 mV/decade (100% hydrous nickel oxide);
Curve G—about 57 mV/decade (composite oxide—0.1% Fe);
Curve H—about 39 mV/decade (composite oxide—1% Fe);
Curve I—about 25 mV/decade (composite (9:1) oxide—10% Fe); and
Curve J—about 19 mV/decade (composite oxide—75% Fe).

FIG. 3 then shows that a composite oxide of the present invention (i.e., Curve I) not only has a low Tafel slope but operates in a range of much lower overpotentials than the other composite oxides tested outside the range of the invention.

FIG. 4 shows the polarization curves for several composite oxide electrodes at various levels of iron content according to the present invention and, by way of contrast, the curve for hydrous nickel oxide. More specifically at 8 mA/cm$^2$ current density:

Curve K—(Ni:Fe::0.6:1) has a Tafel slope of 17 mV/decade;
Curve L—(Ni:Fe::19:1) has a Tafel slope of 27 mV/decade;
Curve M—(Ni:Fe::9:1) has a Tafel slope of 25 mV/decade;
Curve N—(Ni:Fe::1:1) has a Tafel slope of 21 mV/decade; and
Curve O—(iron-free hydrous nickel oxide) has a Tafel slope of 72 mV/decade.

FIG. 4 then shows the distinctly lower oxygen overpotential capability expected in hydrogen generators by using composite oxides in accordance with the present invention.

Other tests were conducted on high surface area (i.e., porous) electrodes which are the more useful in practical hydrogen electrolyzers. For these tests, the substrate was a 0.25 mm thick sintered nickel plaque prepared by sintering INCO 255 nickel powder onto both sides of a 0.1 mm thick perforated nickel foil. In one case, the sinter was impregnated with about 0.25 mg/cm$^2$ of the composite oxide catalyst (9:1) of the present invention. In another case, the sinter was impregnated with a similar loading of iron-free hydrous nickel oxide. Comparative tests were then conducted between these electrodes as well as unimpregnated samples (i.e., sintered nickel only). The results obtained were similar to those obtained on the flat foil electrodes. More specifically, the tests showed that: the sintered nickel electrode had overpotentials of 422 mV (at 8 mA/cm$^2$) and 497 mV (at 80 mA/cm$^2$), and a Tafel slope of 75 mV/decade; the nickel oxide impregnated electrode had overpotentials of 392 mV (at 8 mA/cm$^2$) and 467 mV (at 80 mA/cm$^2$), and a Tafel slope of 75 mV/decade; and the present invention had overpotentials of 232 mV (at 8 mA/cm$^2$) and 262 (at 80 mA/cm$^2$); and a Tafel slope of 30 mV/decade.

The stability of the oxygen overpotential during prolonged polarization was examined. In this regard, the overpotential of iron-free hydrous nickel oxide catalyzed electrodes increased nearly 50 mV while being polarized at 8 mA/cm$^2$ for one day. By way of contrast, the overpotential of electrodes catalyzed with composite oxide (i.e., 9:1::Ni:Fe) according to the present invention increased by only about 1 mV under the same conditions.

A Mossbauer study of composite oxides (i.e., 9:1::Ni:Fe) made in accordance with the present invention indicate the formation of an intimate combination of Fe and Ni on an atomic scale rather than, for example a physical mixture of $Ni(OH)_2$ and FeOOH particles.

Another electrode was prepared and tested, as above, but this time by precipitating the iron hydroxide onto an electrode previously coated with electrochemically precipitated hydrous nickel oxide, ala the Kandler method. In this regard, a previously prepared hydrous nickel oxide coated electrode was dipped for one minute in a 0.1 M solution of ferric nitrate to form an electrode containing about 10% iron. The Tafel slope of the electrode was lowered (i.e., compared to the Fe-free Ni oxide electrode) to 24 mV/decade and the overpotential was lowered by over 100 mV. The electrode exhibited essentially the same initial catalytic performance as that observed with 10% and 50% electrochemically coprecipitated iron and nickel oxide catalysts but did not exhibit the same durability observed for such catalysts.

Finally, tests have shown that at least 20% of the hydrous nickel oxide in the coprecipitated hydrous nickel/iron oxide mix can be replaced with hydrous cobalt oxide with little difference in performance.

While the invention has been disclosed primarily in terms of specific embodiments thereof it is not intended to be limited thereto, but rather only to the extent set forth hereafter in the claims which follow:

The embodiments of the invention in which an exclusive property or privilege is claimed are defined as follows:

1. In an alkaline, electrolytic hydrogen generator comprising an hydrogen-evolving cathode, an oxygen-evolving anode and an aqueous alkai metal hydroxide electrolyte between said anode and cathode, the improvement wherein said anode includes a catalyst supported on a conductive substrate and comprising a composite hydrous oxide of nickel and iron in which the nickel content varies from about 0.6 to about 19 parts nickel per part iron.

2. The hydrogen generator as claimed in claim 1 wherein said nickel content varies from about 1 to about 9 parts nickel per part iron.

3. The hydrogen generator as claimed in claim 1 wherein said catalyst is a substantially uniform coating electrochemically coprecipitated on the surface of said substrate.

* * * * *